US008813528B2

(12) United States Patent
Olear et al.

(10) Patent No.: US 8,813,528 B2
(45) Date of Patent: Aug. 26, 2014

(54) THEFT PREVENTION APPARATUS FOR A PERSONAL ELECTRONIC DEVICE

(76) Inventors: Jordan A. Olear, Hillsborough, NJ (US); Jeffrey R. Olear, Hillsborough, NJ (US)

( * ) Notice: Subject to any disclaimer, the term of this patent is extended or adjusted under 35 U.S.C. 154(b) by 0 days.

(21) Appl. No.: 13/237,357

(22) Filed: Sep. 20, 2011

(65) Prior Publication Data

US 2013/0067967 A1 Mar. 21, 2013

(51) Int. Cl.
*E05B 73/00* (2006.01)

(52) U.S. Cl.
USPC ..... 70/14; 70/18; 70/30; 70/49; 70/58

(58) Field of Classification Search
USPC ..... 70/14, 18, 30, 49, 58, 63; 24/132 R, 24/134 R, 134 P, 115 H, 481; 248/551, 552, 248/553; 206/586, 453, 320; 361/679.57, 361/679.56; 211/4, 8, 9
See application file for complete search history.

(56) References Cited

U.S. PATENT DOCUMENTS

| | | | | |
|---|---|---|---|---|
| 3,804,357 | A * | 4/1974 | Robinett et al. | 248/553 |
| 5,056,664 | A | 10/1991 | Demers | 206/453 |
| 5,285,938 | A | 2/1994 | Fauchald | 224/42.45 |
| D384,585 | S | 10/1997 | Swarr | D9/456 |
| 5,708,560 | A | 1/1998 | Kumar et al. | 361/680 |
| 6,275,378 | B1 | 8/2001 | Lee et al. | 361/686 |
| 6,427,499 | B1 * | 8/2002 | Derman | 70/58 |
| 6,523,373 | B1 | 2/2003 | Su | 70/58 |
| 6,629,440 | B1 | 10/2003 | Meekma et al. | 70/49 |
| 7,185,518 | B1 | 3/2007 | Huang | 70/14 |
| 7,274,564 | B2 | 9/2007 | Rossini | 361/686 |
| 7,302,816 | B1 | 12/2007 | Lu | 70/58 |
| 7,308,809 | B2 | 12/2007 | Lu | 70/58 |
| 7,352,566 | B2 | 4/2008 | Huang et al. | 361/683 |
| 7,744,138 | B2 | 6/2010 | St. Germain | 294/74 |
| 2002/0134119 | A1 * | 9/2002 | Derman | 70/58 |
| 2006/0176661 | A1 | 8/2006 | Allen | 361/683 |
| 2008/0013269 | A1 | 1/2008 | Wong et al. | 361/683 |
| 2008/0236209 | A1 * | 10/2008 | Conti et al. | 70/18 |
| 2011/0080137 | A1 * | 4/2011 | Avganim | 320/115 |
| 2012/0103863 | A1 * | 5/2012 | Perez et al. | 206/586 |

OTHER PUBLICATIONS

Kensington 64068F MicroSaver Notebook Lock and Security Cable web page of product sold on amazon.com.
Kensington 64343 MicroSaver Ds Notebook Computer Lock with Keys web page of product sold on amazon.com.

(Continued)

*Primary Examiner* — Lloyd Gall
*Assistant Examiner* — Duoni Pan
(74) *Attorney, Agent, or Firm* — Mark A. Garzia, Esq.; Law Offices of Mark A. Garzia, P.C.

(57) ABSTRACT

An apparatus for securing a personal electronic or hand held device (PED), includes a housing for a "pull-tight" lock mechanism attached to an elongated, flexible cable looped through a plurality of corner pieces, and a lock for releasable attachment proximate the distal end of the cable for looping the cable around a secure stationary work object and back through a cable accepting means on said "pull-tight" lock housing. A releasable locking mechanism is disposed within said housing to allow movement of said cable in the first direction, but not in the direction opposite from the first direction when the cable is slidably engaged or "cinched" tight through the corner pieces and secured around the PED by the user.

10 Claims, 5 Drawing Sheets

(56) References Cited

OTHER PUBLICATIONS

Universal Tablet Holder page from srcok.com's website, specifically: www.srcok.com/src-products/tablet-security-devices.aspx.aspx.

Tablet Gripper page from product website, specifically: www.stacey-europe.com/security-products/18/Tablet-Gripper.aspx.

Maclocks Tablet Lock page from maclocks.com's website. specifically: http://www.maclocks.com/index.php/imac-locks/ipad-2-security-case-and-lock-bundle-1.html?SID=b012d94cc0c8122cf70b1ce24d104548.

Dual Lock Vent Mount + Apple Ipad 2 Tablet PC Holder/Stand (pages from aliaba.com's website, specifically: http://www.alibaba.com/product-gs/503888708/Dual_Lock_Vent_Mount __Tablet_PC.html) [6 pages].

* cited by examiner

THEFT PREVENTION APPARATUS FOR A PERSONAL ELECTRONIC DEVICE

FIELD OF THE INVENTION

The present invention relates generally to a theft prevention apparatus for use on a hand-held or personal electronic device (PED) and, in particular, to a security lock for an iPad® or similar tablet computer device.

BACKGROUND OF THE INVENTION

Security apparatus for preventing the theft of laptop or notebook computers are well-known in the art. Most involve physically attaching a cable to the laptop and looping the cable around a large, preferably immovable, object.

A number of different apparatus have been developed to prevent the theft of an electronic device (usually a netbook or notebook computer); many employ a cable to attach the electronic device to a fixed object. For example, the website maclock.com sells several theft deterrent devices and at least one specifically for use with an iPad®. One theft deterrent offered for sale is a device that consists of a plate, and a cable having a "locking head" attached to one end. The plate is glued to the back of a tablet device. The cable is looped around a fixed object and the locking head is secured to the plate. Another theft deterrent device sold on the maclock.com website comprises a hard plastic case with a small slot formed into one side of the case, and a cable having a keyed lock attached to one end. The plastic case encases the iPad® on five sides, leaving only the front screen uncovered. Since the hard plastic case must be precisely sized, it only can be used for an iPad®. In order for this device to successfully operate as a theft deterrent, the plastic case must be glued either to the iPad® or onto itself so that it cannot be separated from the iPad® The cable is looped around a fixed object and the lock is secured to the case by engaging the slot in the case.

A different take on a theft prevention device is shown in U.S. Pat. Pub. No. 2006/0176661 to Allen. U.S. Pat. Pub. No. 2006/0176661 discloses a locking assembly for a notebook computer or other personal electronic device having a locking base that attaches to the computer and is physically secured to a working surface. Namely, the locking assembly includes several embodiments composed of one of the following or a combination thereof: a rear wall and a rearwardly extending locking flange, a locking frame, a wire mesh accessory cage, a pivoting locking rod, a security clamp, fasteners, brackets, locking peg, pin lock, or a cable and clamp combined with a locking base. (In view of the structure of this embodiment of Allen's theft prevention apparatus, it appears that it can be used only with a device having a clamshell design and not with a tablet computer.) A drawback of the primary embodiment of the Allen invention is that the notebook computer is physically secured to the table top in such a manner that it prevents the user from lifting, moving or making other adjustments to the notebook, thereby making it uncomfortable to use the notebook for extended periods.

Another theft prevention apparatus, which is the subject of U.S. Pat. No. 7,185,518 to Huang, discloses a safety lock for a computer comprising a lock set in a housing wherein the housing is connected to a cable. The lock has locked and unlocked positions and communicates with a lock axle that engages a hole in the computer.

Similarly, U.S. Pat. No. 7,302,816 to Lu discloses a computer security lock comprising a housing having a key-operated lock and security cable. The lock is connected to a pair of levers that have a scissor like motion for engaging a preformed hole in a computer when the lock is locked. The computer is secured by looping the cable around a stationary object and then inserting the second end of the cable into the hole in the computer housing and attaching the cable to the computer by means of a cable holder.

Many theft prevention apparatus require a hole in the housing of the electronic device which, absent an agreement with a computer manufacturer, must be drilled by the computer owner. While these prior art apparatus may be acceptable for larger electronic equipment, such as a notebook computer, they may not be desirable and may even damage a smaller hand held device. A primary reason is that tablet computers are usually only a fraction of an inch thick and there is insufficient room to drill a hole into the tablet. Also, the slightest penetration into the housing may hit an electronic component. This method would require the PED manufacturer's assistance or it could cause the manufacturer's warranty to become void if the owner of the PED drills a hole through the case in order to attach one of the previously known theft prevention apparatus.

It is also well known in the art to use rubberized bumpers and durable hardshell covers to enhance edge and corner protection of PEDs and prevent damage from falls, or scratches. For example, OtterBox® makes a number of cases of varying sizes and shapes that protect a hand-held device (primarily cell phones) from damage. Other manufacturers make skins that may be applied to a hand-held device and are for purely decorative purposes. While these types of devices are useful for safety purposes or aesthetics, they do not protect the device from theft.

SUMMARY OF THE INVENTION

It is a primary object of the present invention to disclose an apparatus for preventing theft of a PED and, in particular, an apparatus for preventing theft of a tablet computer (e.g., an iPad®) or similar hand-held device.

Another object of the present invention is to disclose a theft prevention apparatus that secures the PED while still permitting the user the flexibility of moving and positioning the PED freely.

Other objects will become apparent from the following description of the subject invention.

The theft prevention apparatus that is the subject of this invention utilizes an adjustable cable lock similar to a lock used for securing a movable object to a fixed object such as a bicycle to a bicycle rack. (One example is the Python Adjustable Cable Lock manufactured by the Master Lock Company.) The subject security device is desirable as it allows the user to secure their portable electronic device to a fixed object (e.g., a table or a chair) when used in a public area, without having to forego the freedom of using the portable device. Also, in contrast with many notebook computer security devices, it is not required to drill a hole in the PED that is to be protected which in all likelihood would violate the manufacturer's warranty.

The present invention allows a user to secure a PED (such as a tablet computer) to a stationary object by using a "pull-tight" cable lock system and a plurality of pliable, gripping corner pieces. The subject cable lock is used to secure the PED to a larger and, preferably, non-moveable object. This method is advantageous because it allows the user to freely operate the PED at a work station while continuously protecting the device from theft. Therefore, if the user absent-mindedly walks away, the PED is still protected. In addition, the user of the subject invention keeps the option of moving, lifting and/or re-positioning the PED thereby retaining the flexibility and comfort associated with using the PED.

In one embodiment, the theft prevention apparatus includes four corner pieces with either circular or semicircular channels through which a cable may be thread. The cable is connected at one end to a lock; the lock comprises a housing within which is an adjustable cable lock (sometimes referred herein as a "pull-tight" lock) mechanism. The cable is threaded through the corner pieces and returned back to the lock to communicate with the "pull-tight" lock mechanism to form a loop within which the PED will be secured by tightening or cinching the cable and bringing the corner pieces in stable contact with the PED. The corner pieces remain in constant contact with the PED as long as the slack in the cable is removed, and the cable is tightened against the corner pieces. The other end of the cable (or a second cable) is then looped around a stationary object such as a table leg or chair, and then directed back to the lock and secured by a second pull-tight lock mechanism.

Alternatively, the second end of the cable may be connected to a cable accepting means on the lock housing where it is connected to a combination lock for releasable attachment. In another embodiment, instead of a combination lock, the lock for releasable attachment may be a pad lock with a removable key that the user may carry away with them.

In an alternate embodiment, instead of four separate corner pieces, one continuous casing measured to fit and snugly surround the entire perimeter of the PED may be used, having a channel for accepting the cable. This embodiment is similar in appearance to an OtterBox® case, and has the advantage of including additional features into the theft protection apparatus such as a screen protector for the PED. The full perimeter casing may be composed of either a soft or hard shell (or both) that would prevent damage to the PED if the PED is accidentally dropped from a short height such as the distance from a table top to the floor.

The cable is composed of flexible nylon multi-stranded steel, or other durable material. The cable may be 3-4 mm in diameter, more or less, and insulated with a protective polymer coating to reduce friction and increase strength for anti-theft purposes. The diameter of the cable can be adjusted for the thickness of the electronic device that is being protected.

In yet another embodiment, the security device may contain an audio or visual alarm that is triggered when a thief attempts to remove the PED from the work space, by either an alarm that is triggered if the cable is tampered with or by a motion sensor.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Figure 1:
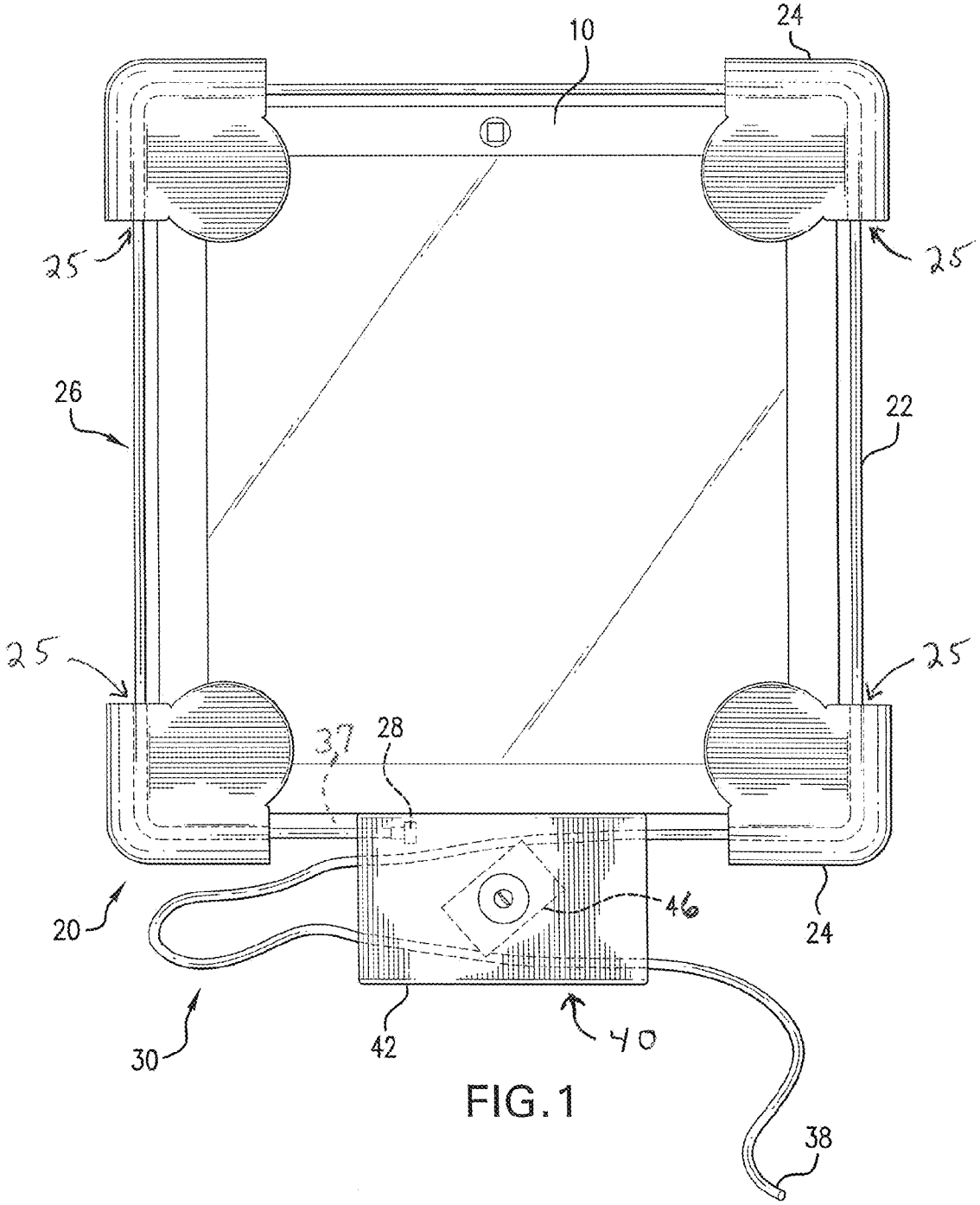
FIG. 1 is a top view of the apparatus for preventing theft of a PED.

The subject theft prevention device 20 is shown in FIG. 1, attached to a tablet computer or PED 10. The primary elements of the theft prevention device 20 are a cable 22, a plurality (usually four) of corner pieces 24, and a lock 40. The corner pieces 24 are made to receive the corners of the PED 10. The lock 40 includes a housing 42, a means (e.g., a rivet-like cap 28) for securing a first end of the cable, and an adjustable cable lock mechanism 46 (sometimes referred to as a releasable "pull-tight" locking mechanism) located on or in the housing.

The cable 22 of the present invention is an elongated flexible cable 22 having a first end 37 and a second end 38. The cable 22 is preferably a coated cable of 3-4 mm in diameter. Said first end of the cable is terminated with a rivet 28 which is secured to the housing 42 of the lock 40. The adjustable cable lock mechanism 46 grips the cable 22 at different points when the cable is pulled through the adjustable cable lock mechanism 46. The adjustable cable lock mechanism 46 prevents the cable from moving in one direction until the user decides to release the grip. The adjustable lock is similar to the mechanism found in adjustable cable locks for bicycles. (See, for example, Master Lock Brand Model No. 8413 for the Python Adjustable Cable Lock, which is described in U.S. Pat. No. 6,629,440 to Meekma et al.)

The cable 22 used with the lock 40 is preferably a coated cable of about 3-4 mm in diameter. In a preferred embodiment, the cable 22 must be sufficiently long to form two loops 26, 30. The first loop 26 must, at a minimum, be slightly larger than the perimeter of the PED 10 to be protected for reasons that will become apparent below. The second loop 30 may be of virtually any desired or convenient length. Alternate embodiments of the present invention will be apparent to a person skilled in the art after a reading of this disclosure; for example, instead of a single length of cable forming two loops, two separate cables may be employed—one to form the first loop and the second to form the second loop. These alternate embodiments would come under the scope of the attached claims.

Figure 2:
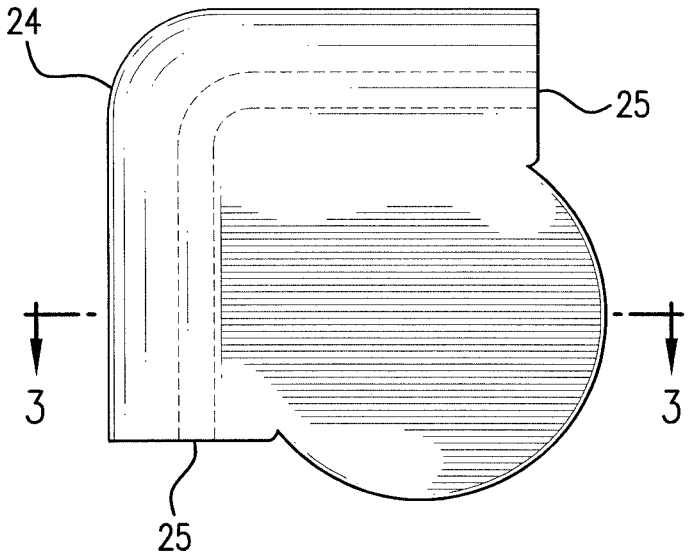
FIG. 2 is a top view of a corner piece.
Figure 3:
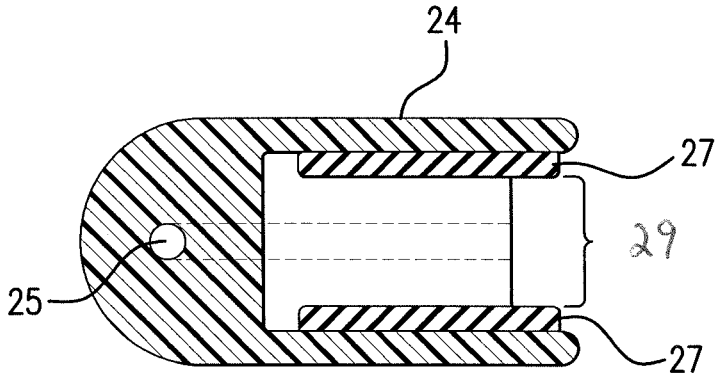
FIG. 3 is a lateral view of a corner piece.

Referring now to FIGS. 2 and 3, each corner piece 24 of the present invention has a channel 25 having sufficient width and depth to accept the cable 22, and to allow the cable 22 to slide within the channels. The corner pieces 24 also protect the PED from damage from the cable or, for example, from a drop. Said channels 25 may be fully or partially enclosed; fully enclosed channels are illustrated in FIGS. 2 and 3. The channels must be sufficiently large to allow the cable 22 to slide therein when the cable is being cinched. The length of cable 22 will be adjusted by pulling the cable through the adjustable cable lock mechanism 46, which tightens the cable around the PED 10 pressing the corner pieces firmly against the corners of the PED. These channels 25 serve both as a guide for the cable 22 around the PED 10 and to releasably secure the corner pieces 24 to the PED 10, until the cable 22 is sufficiently tightened (and locked down by the adjustable cable lock mechanism 46) thereby removing all slack from the cable.

Figure 4:
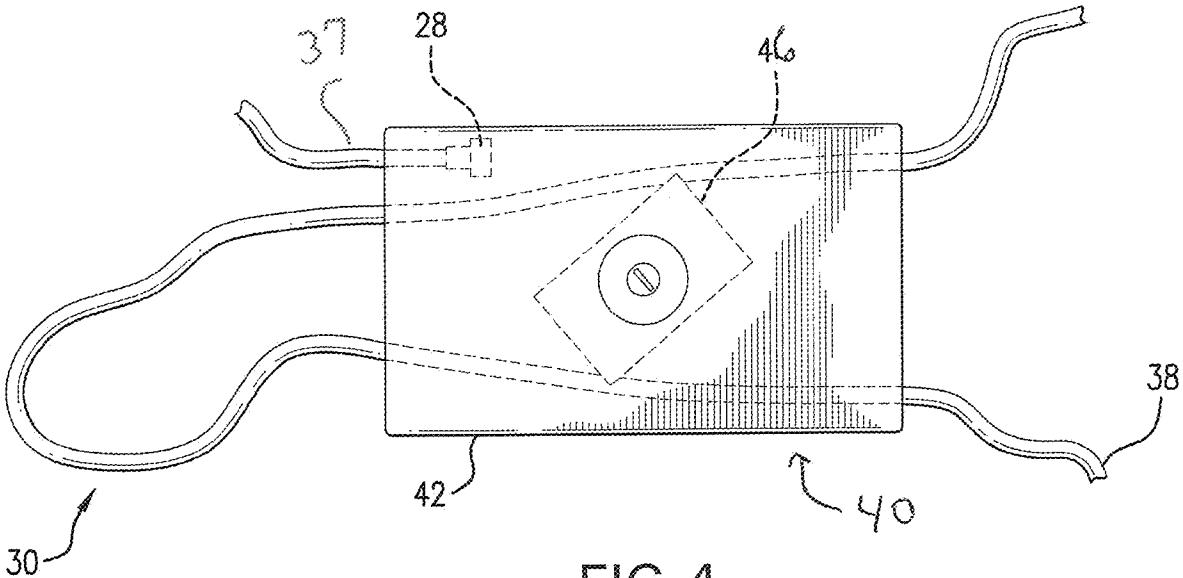
FIG. 4 is a top view of "pull-tight" lock and housing.

Referring now to FIG. 4, the lock 40 comprises a releasable cable-locking mechanism 46 disposed within said housing 42 wherein said cable 22 is slidably received. The releasable locking mechanism 46 allows free movement of said cable 22 in a first direction relative to the locking mechanism 46, but not in the direction opposite from the first direction; therefore, the user can pull cable 22 through the locking mechanism 46 (i.e., the first direction) until the cable 22 is "cinched" or tightened, thereby reducing the size of the first loop so that the corner pieces are firmly secured against the corners of the PED. When the user stops pulling the cable 22, the locking mechanism 46 automatically engages, preventing the cable from moving in the direction opposite to the direction the user just pulled the cable, and locking the cable in place.

If the theft prevention device is no longer needed (e.g., the user is using the PED in a safe place such as the user's home and not in a public place), the user can manipulate the locking mechanism 46 to release the cable 22 allowing the cable to move in the opposite direction thereby releasing the tension that the cable applies to the corner pieces (i.e., allowing first loop 26 to loosen so that the four corner pieces 24 are no longer securely pressed against the PED 10). Without the tension applied by the cable 22, the four corner pieces may still be in place against the PED (since they are designed to frictionally fit around the corners of the PED), but the corner pieces 24 can now be easily removed.

The lock 40 used in the subject invention is similar to adjustable cable locks known and used in the manufacture of certain bicycle locks (which usually use a larger diameter cable). Although a custom adjustable cable lock may be designed for this invention, it would not take a significant effort to modify an adjustable cable bicycle lock for use in the present invention.

If the channels 25 are fully enclosed, said second end of the cable 38 is slidably received through each of the corner pieces 24 and then fed back through the releasable locking mechanism 46 disposed within the housing 42, thereby forming the first loop 26 within which a PED 10 will be secured. (Of course, the anti-theft apparatus can be sold with the corner pieces having already been threaded onto the cable.) If the corner pieces 24 are made with partially enclosed channels, the user may first attach the corners to the PED 10, and then manually insert the cable so that it nestles within the channel of each corner piece 24.

The cable 22 should be of sufficient length to form the second loop 30 extending away from the housing 42 for capturing an object 90 proximate to the PED 10 such as a table leg, chair, or a stationary working surface 90. Although second loop 30 may be secured to the lock 40 using a second adjustable cable locking mechanism (identical to the locking mechanism 46), it is not necessary to use this type of lock since the second loop does not need to be tightened or cinched.

Figure 5:
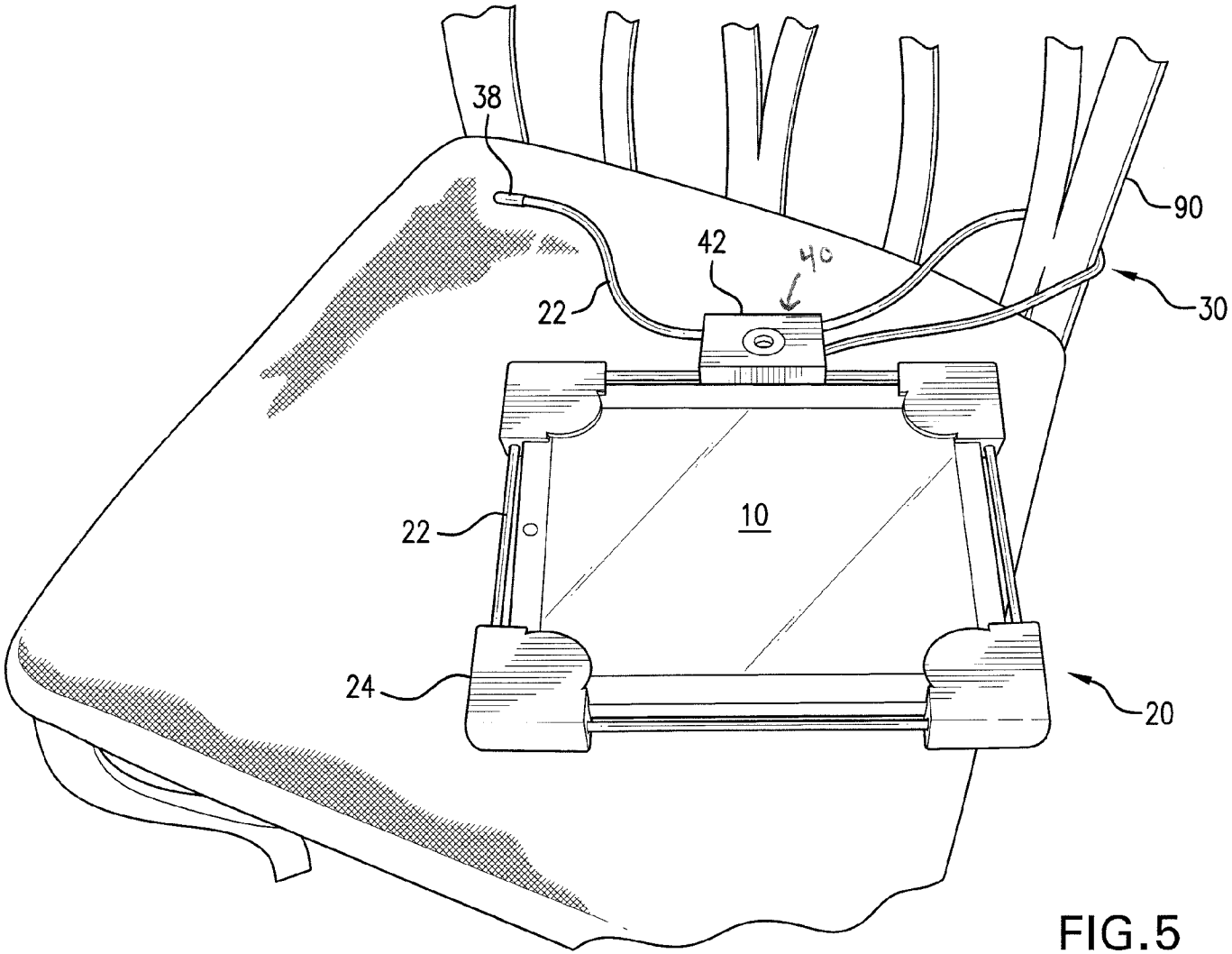
FIG. 5 is a PED and theft prevention apparatus secured around a captured object.

Referring now to FIG. 5, the theft prevention device 20 is shown secured around a stationary object. In FIG. 5, the stationary object is a chair. Any portion of the chair may be suitable to loop the second end of the cable around, for example, a leg, a rung, a spindle or cross rail. In FIG. 5, the second loop 30 is shown around a spindle 90. Many public places (e.g., libraries or study areas at universities) have tables that are secured to the floor which would also be suitable around which to form the second loop of the cable. The second end of cable 22 is then brought back to the housing 42 and secured to prevent the cable 22 from pulling back through the cable accepting means 48 and maintaining the size of the second loop 30.

Four corner pieces 24 are shown in FIGS. 1, 2 and 3. The corner pieces 24 are preferably made from injection molded plastic and designed with an opening 29 that will accommodate the thickest electronic tablet on the market today. A foam rubber insert 27 may be attached inside the opening 29 of each corner piece 24 where the corner of the PED 10 is inserted therein. The insert 27 is made to collapse or flatten against the top and bottom of the corner piece 24. The insert 27 will hold the corner pieces 24 on the tablet 10 via a friction fit while the user is guiding the cable 22 into the channels 25 and around the PED 10. The inserts 27 will allow for the theft prevention apparatus 20 to be used on PEDs of varying thickness; also, they can be used to allow the corner pieces 24 to more easily slide over the corner of the PED, and to protect the PED as the corner pieces 24 are slid on and off. For example, the inserts 27 will not collapse as much when used with a thinner PED; however, they will retain sufficient firmness to ensure the friction fit of the corner pieces with the corner of the thinner PED. Although the dimensions of the corner pieces 24 (especially opening 29) may be adjusted during the manufacturing process in order to accommodate PEDs of varying thickness (e.g., an iPad® is approximately ⅓ inch thick), it would be more convenient from a commercial standpoint to include inserts 27 of varying thicknesses with each theft prevention apparatus 20.

Because most tablet computers 10 are rectangular in shape, and measure six to ten inches on each side, one set of four corner pieces 24 can be used with a variety of tablet sizes from different manufacturers. Since the corners of a tablet device 10 are 90 degrees, the corner pieces are also approximately 90 degrees and are manufactured so that they can receive the corners of the tablet device 10. The cable 22, attached at one end to the lock housing 42, is thread through all four corner pieces. The cable 22 is then thread back through the adjustable cable lock mechanism 46 to form a substantially square or rectangular loop 26 that fits around the perimeter of the tablet device 10. The cable 22 is cinched or tightened around the PED 10 to secure all four corner pieces 24 in place by pulling the cable 22 through the adjustable cable lock mechanism 46. When the first loop 26 formed by the cable 22 is tightened, the corner pieces 24 will be pressed against the corners of the PED 10 such that the corner pieces 24 are effectively secured to the PED 10, and can not be moved unless the tension applied by the cable 22 is released by unlocking or releasing the adjustable cable lock mechanism 46.

The corner pieces 24 and their interaction with both the cable 24 and the PED 10 is an important feature of the subject invention. The tightening of the cable around the perimeter of the PED allows users to operate the PED under continuous protection by the subject theft prevention apparatus 10 while retaining the flexibility that makes PEDs popular.

The first end of cable 22 is attached to the housing 42 of the lock 40. In the embodiment illustrated in FIG. 1, the first end of the cable 22 is secured by rivet-like cap 28 that prevents the end of the cable from sliding through a hole in the housing 42; the other end of the cable is thread through the four corner pieces 24 around the PED 10 and then fed back through the adjustable cable lock mechanism 46; this forms the first loop 26. When the cable is cinched by pulling the cable through the locking mechanism 46, first loop 26 decreases in diameter and tightens around the perimeter of the PED thereby securing the corners to the PED 10. The second end of the cable is looped around the stationary object 90 (for example a leg of a table) and then thread back through a second adjustable cable locking mechanism within the housing 42; this forms the second loop 30. In the embodiment illustrated in FIGS. 1 and 4, the lock 40 performs a double duty by acting as the base used to form both loops 26, 30.

In one embodiment, the lock 40 has two "pull-tight" locking means 46 within the housing. One is used to releasably secure the cable to form the first loop 26 and the second to releasably secure the cable to form the second loop 30. However, the second loop does not need to be cinched or pulled tight against the immovable object; thereby allowing any number of means to secure the PED to the immovable object via second loop 30.

Figure 6:
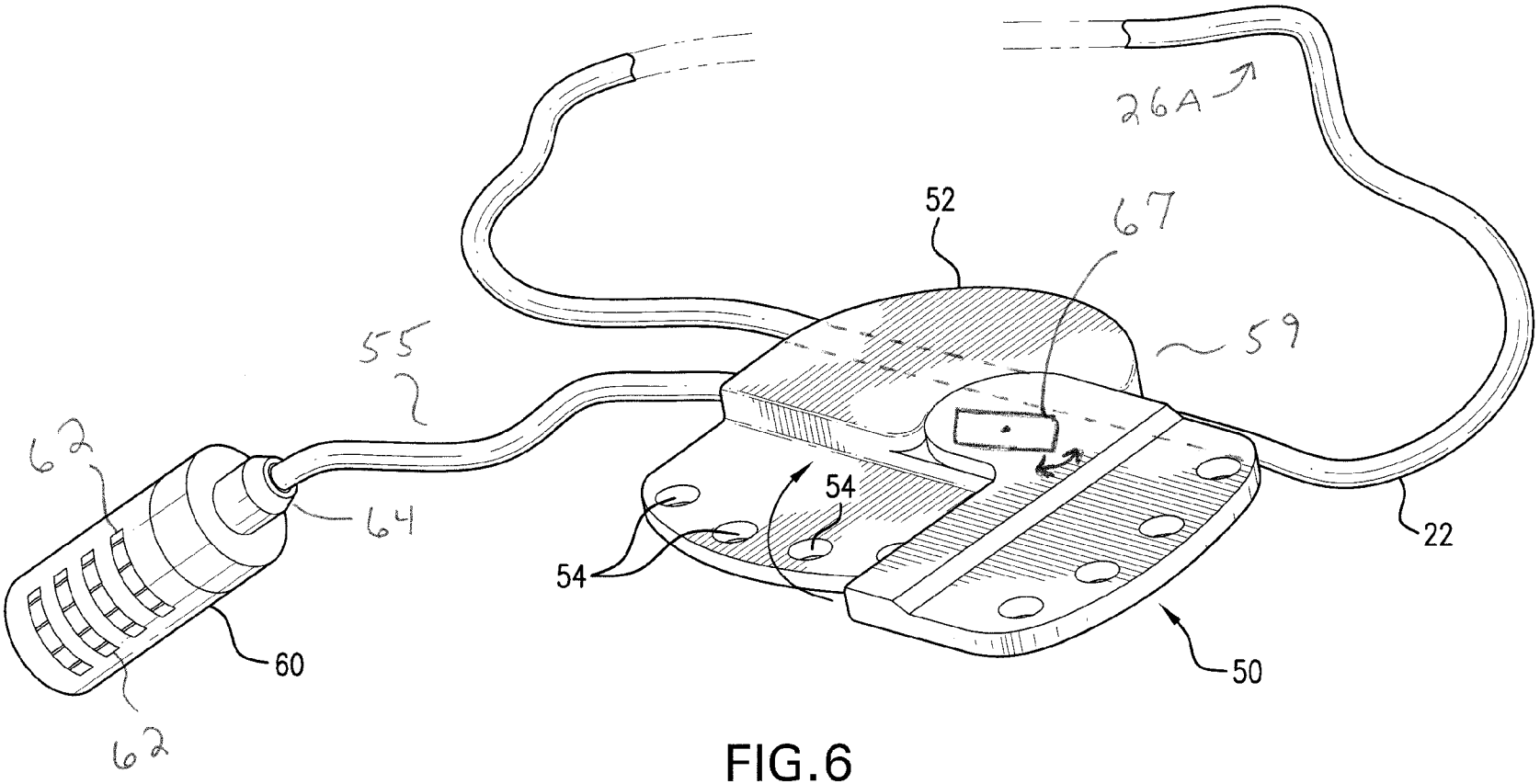
FIG. 6 is an alternate embodiment of the "pull-tight" lock having a cable accepting means in the housing and including a lock for releasable attachment of the second end of the cable.

Instead of utilizing a pull-tight locking mechanism 46, an alternative embodiment is shown in FIG. 6 which utilizes a compression lock 52. FIG. 6 is an alternate embodiment of the theft prevention device 10A comprising a compression lock 52, having a housing 59 and a rotating arm 50 in accordance with the present invention. As with the embodiment described above, the first end of cable 22 is attached to a lock housing 59, threaded through the four corner pieces 24 and then threaded back through the cam/compression cable lock mechanism located within the housing. A lock for releasable attachment 60 is attached to the second end 55 of cable 38 during product assembly. The corner pieces 24 are placed on the PED 10 and the cable 22 is pulled through the lock 52 so the cable accepting means 54 line up. The lock for releasable attachment 60 may be a combination lock as illustrated having rotating discs labeled with numbers 62 and a pin with several teeth which hook into the rotating discs 62. (This type of lock is well known and may also be found in a specific class of bicycle locks.) To secure the device, the combination lock 60 is detached from the cable 22, the second end 55 of the cable is then looped or guided around the stationary object 90. The lock pin 64 is pushed through the cable accepting means 54 and the combination lock 60 is then placed back on the lock pin 64 and the dials 62 are rotated to lock the combination lock on the end of the cable. The second loop 30 is now fixed around the stationary object 90 and the PED is prevented from being lifted by a thief.

In operation, the first loop 26A is formed around the PED 10 as in the previous embodiment. The second end of the cable 55 is pulled tight, thereby tightening the first loop around the PED. When the cable is sufficiently taught so that the corner pieces are secured against the corners of the PED, the locking arm 50 of the compression lock 52 is rotated into position so that the holes in the locking arm are aligned with the holes in the housing of the compression lock. The locking arm 50 is attached to a cam 67 that rotates with the locking arm and squeezes against the cable and increases pressure against the cable as locking arm 50 is rotated. Once the holes of the rotating arm 50 align with the holes 54 of the housing, there is sufficient pressure against the cable preventing the cable from sliding back, thereby maintaining the size of the first loop 26A and keeping the tension on the corners against the PED. (Note that this type of rotating arm/cam mechanism can also be found in certain types of bicycle locks.) The second end of the cable terminates in a pin 64 having a plurality of teeth for engaging the pins of a small lock (in this embodiment, a combination lock 60 is illustrated, but a key lock may be employed). The second end 55 of the cable is looped around an immovable object; the combination lock 60 is removed, exposing the pin which is then inserted through one set of the aligned holes of the locking arm 50. Once the pin 64 and a portion of the cable is inserted through the aligned holes, the combination lock 60 is secured to the teeth of the pin, thereby preventing the second end of cable 55 from pulling back through the aligned holes 54, and forming second loop 30. By inserting the pin 64 and a portion of the cable through the aligned holes, the locking arm 50 is prevented from moving, so that the cam will continue to squeeze the cable ensuring the size/shape of first loop 26A; this also ensures that tension to the corner pieces securing the PED is maintained Various embodiments based off of the theft prevention apparatus illustrated in FIG. 6 may be made. For example, instead of using a single cable to form both loops, two separate cables may be employed. The first end of the second cable is secured to the housing of the lock 40 (for example, by using a similar rivet-like cap 28 used on the first end of the cable that forms the first loop, or welding the end of the cable to the housing, etc.).

The use of corner pieces of different dimensions, inserts of different materials, sizes and stiffness, and the fact that the cable is tightened removing slack to force the corner pieces against the PED allows the subject invention to be used with a wide variety and sizes of devices—not just tablet computers.

Although this invention has been described and illustrated by reference to specific embodiments, it will be apparent to those skilled in the art that various changes, modifications and equivalents may be made which clearly fall within the scope of this invention. The present invention is intended to be protected broadly within the spirit and scope of the appended claims.

We claim:

1. A theft prevention device for use on a personal electronic device comprising:

a) a housing having a first means for allowing a cable to pass through the housing;

b) an elongated flexible cable having a first end and a second end, said first end of the cable being attached to said housing;

c) a plurality of corner pieces; each corner piece adapted to accept, and shaped to accommodate a corner of the personal electronic device, said corner pieces having channels through which said second end of the cable is thread; said cable thereby forming a loop around the personal electronic device as the second end of the cable is thread through said channels, such that when the loop formed by the cable is tightened, the corner pieces will be pressed against the corners of the personal electronic device such that the corner pieces are effectively secured to the personal electronic device;

d) a releasable and adjustable pull-tight lock disposed within said housing to grab and secure the cable as said cable is fed back through said first cable pass-through means and to gradually take up any slack in said loop to decrease the size of the loop, thereby maintaining the relative position of the personal electronic device such that continuous pressure is applied to the corner pieces ensuring that the corner pieces do not move with respect to the personal electronic device;

e) the cable being of sufficient length to form a second loop extending away from the housing for capturing an object proximate to the personal electronic device, the second end of the cable being thread back through a second means for allowing the cable to pass through the housing; and f) a cable lock for releasable attachment proximate the second end of the cable to prevent the cable from pulling back through the second cable pass-through means and maintaining the size of the second loop.

2. The theft prevention device of claim 1 wherein said proximate object may be selected from the list that includes a leg of a table, chair, or other stationary work space upon which the personal electronic device sits.

3. The theft prevention device of claim 1 wherein said cable is secured around said electronic device by threading said cable through said channels of said plurality of corner pieces; said cable is cinched tight through the pull-tight lock to remove any slack.

4. The theft prevention device of claim 1 wherein corner pieces comprise:

a) a lining with a soft gripping material to secure the corners of the personal electronic device within the corner pieces; said lining of corner pieces is composed of a foam rubber or similar gripping material insert; and b) said channels which may be fully or partially enclosed to allow said cable to be slidably received.

5. The theft prevention device of claim 1 wherein said cable is threaded through said corner pieces and pulled through said pull-tight lock thereby pressing said corner pieces so that they fit snugly against said electronic device.

6. The theft prevention device of claim 1 wherein the pull-tight lock comprises:

a cable lock mechanism disposed within said housing proximate to said first cable pass-through means, said cable lock mechanism having at least two positions, including a locked position that engages said cable and prevents movement of said cable in a first direction; relative to said housing, but allows movement of said cable in a direction opposite from the first direction, thereby permitting the tightening of said corner pieces against the corners of the personal electronic device, and a second position that allows movement of said cable in both of the aforesaid directions thereby releasing the tension on said corner pieces such that the personal electronic device may be separated from the theft prevention device.

7. The theft prevention device of claim 6 wherein said cable lock mechanism is engaged when in said locked position by threading the cable end through the first cable pass-through means in said direction opposite from said first direction until said cable engages said cable lock mechanism until said corner pieces are tightened against the corners of the personal electronic device.

8. The theft prevention device of claim 1 wherein said cable is looped around a stationary work space and secured by passing the cable end through said second cable pass-through means on the pull-tight lock and connecting the cable end with an appropriate lock for releasable attachment.

9. The theft prevention device of claim 1 wherein said cable is composed of flexible multi-stranded steel, nylon, or other durable material.

10. The theft prevention device of claim 9 wherein the cable is a coated cable of 3-4 mm in diameter.

* * * * *